United States Patent [19]

Evans et al.

[11] 4,283,161

[45] Aug. 11, 1981

[54] METHOD AND APPARATUS FOR A GUARD

[75] Inventors: Orde R. Evans; William D. Rhodes; Joseph O. Trahan, all of Lafayette, La.

[73] Assignee: Oreco III, Inc., Lafayette, La.

[21] Appl. No.: 911,909

[22] Filed: Jun. 2, 1978

Related U.S. Application Data

[63] Continuation-in-part of Ser. No. 784,585, Apr. 4, 1977, abandoned.

[51] Int. Cl.[3] ..... E02D 5/60

[52] U.S. Cl. ..... 405/216; 52/725; 52/727

[58] Field of Search ..... 405/211, 216; 52/725, 52/727, 728; 138/128; 264/31, 35

[56] References Cited

U.S. PATENT DOCUMENTS

| | | | |
|---|---|---|---|
| 2,109,508 | 3/1938 | Schmittutz | 52/728 X |
| 3,321,924 | 5/1967 | Liddell | 405/216 |
| 3,553,970 | 1/1971 | Wiswell | 405/216 |
| 3,890,795 | 6/1975 | Maurer | 405/216 |
| 4,019,301 | 4/1977 | Fox | 52/727 X |

FOREIGN PATENT DOCUMENTS

| | | | |
|---|---|---|---|
| 739848 | 10/1943 | Fed. Rep. of Germany | 138/128 |

*Primary Examiner*—David H. Corbin
*Attorney, Agent, or Firm*—Guy E. Matthews

[57] ABSTRACT

The present invention relates to a new and improved method and apparatus for installing and thereby protecting existing offshore structures, existing platforms and flow line risers in the splash and/or wave action zone.

6 Claims, 8 Drawing Figures

S
W
H
10
5
5
10
10

S
26
10
24
28

10
16
12
14
H
18
L 15
10
S
20
22
16
18

T
16
22
14
12
20
18

METHOD AND APPARATUS FOR A GUARD

CROSS REFERENCE TO RELATED APPLICATIONS

This application is a continuation-in-part of application Ser. No. 784,585, filed on Apr. 4, 1977, now abandoned.

BACKGROUND AND BRIEF SUMMARY OF THE INVENTION

Briefly, the present invention relates to a new and improved method and apparatus for enabling protection of offshore flow line risers and existing platforms by wrapping such risers and platforms with a flexible membrane, such as rubber, in a suitable manner to protect such structures from damage due to waves and from biological growths, such as barnacles, which causes such structures to weaken.

In the prior art, it is known to protect offshore structures having legs and flow line risers which extend upwardly from the ocean floor to above the water line, both below the water line and above the water line. However, at the present time, applicant knows of no devices for such legs, structures, flow line risers, or other apparatus, which is positioned in the wave action or splash zone area of such structure for protection from the environmental conditions, such as caused by the continual beating of waves, rust and from the biological growth.

One object of the present invention is to provide a new and improved guard for protecting existing platforms, structures, flow line risers and the like from the continual beating and pounding occurring to such structures in the wave action of splash zone area.

While the invention will be described in connection with preferred embodiments and procedures, it will be understood that it is not intended to limit the invention to those embodiments and procedures. On the contrary, it is intended to cover all alternatives, modifications and equivalents as may be included within the spirit and scope of the invention as defined by the appended claims.

DESCRIPTION OF THE PREFERRED EMBODIMENT

Figure 1:
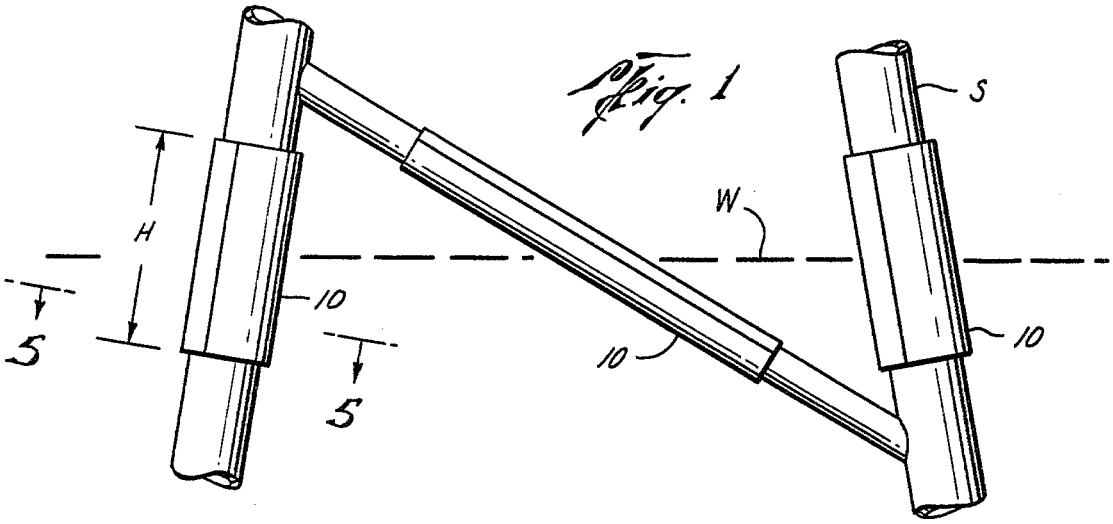
FIG. 1 is a perspective view, partly in section, of the apparatus of the present invention mounted with offshore structure in the splash zone area.
Figure 2:
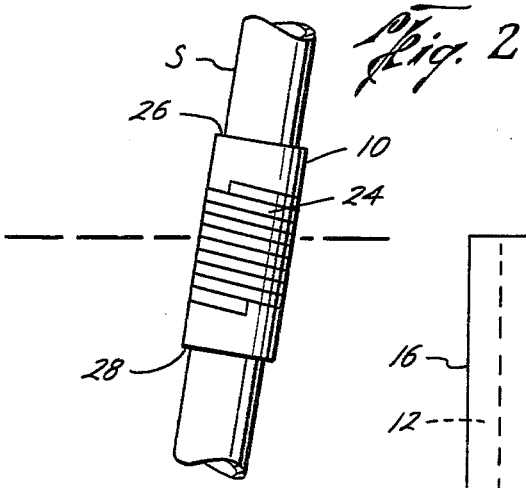
FIG. 2 is yet another perspective view of the present invention illustrating strips of tape or other suitable material being wound around the body to even out the positioning of suitable bonding material mounted with the structure and the guard of the present invention.
Figure 3:
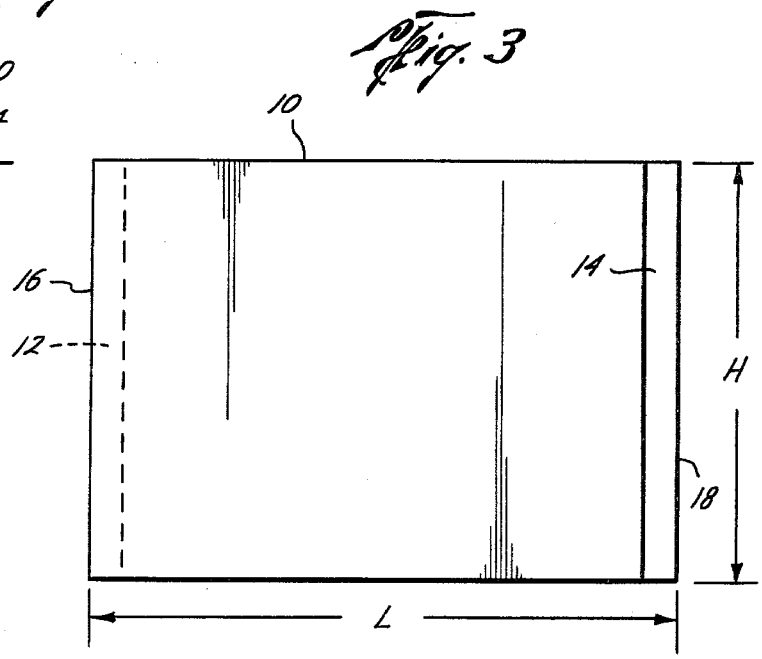
FIG. 3 is an elevational view of an unwrapped piece of material illustrating certain aspects of the present invention.

As illustrated in FIGS. 1, 2 and 3, the present invention, includes a suitable flexible material, such as rubber, polyethylene or other material having a body 10 which is capable of being wrapped around tubular or other members in a wave action of splash zone W of existing offshore structure, flow line risers and the like. As is known, the splash zone or wave action area W, subjects such existing structures S to terrific pounding which causes such structures to weaken, subjects such structures to erosion and corrosion and to certain biological growths, such as barnacles, which further causes such structures to weaken. The lack of protection for such structures has cost the oil and other industries millions of dollars yearly for replacement, or in research to attempt to find suitable coatings for structures in such area.

Figure 5:
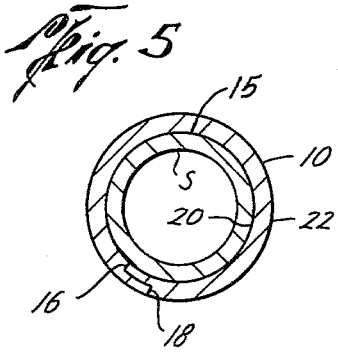
FIG. 5 is a cross-sectional view of a guard of the present invention in its wrapped state.
Figure 4:
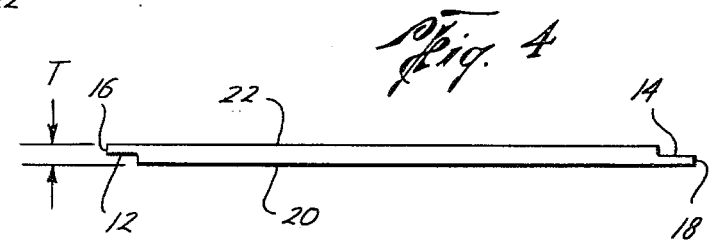
FIG. 4 is a plan view of the unwrapped piece of material shown in FIG. 3.
Figure 6:
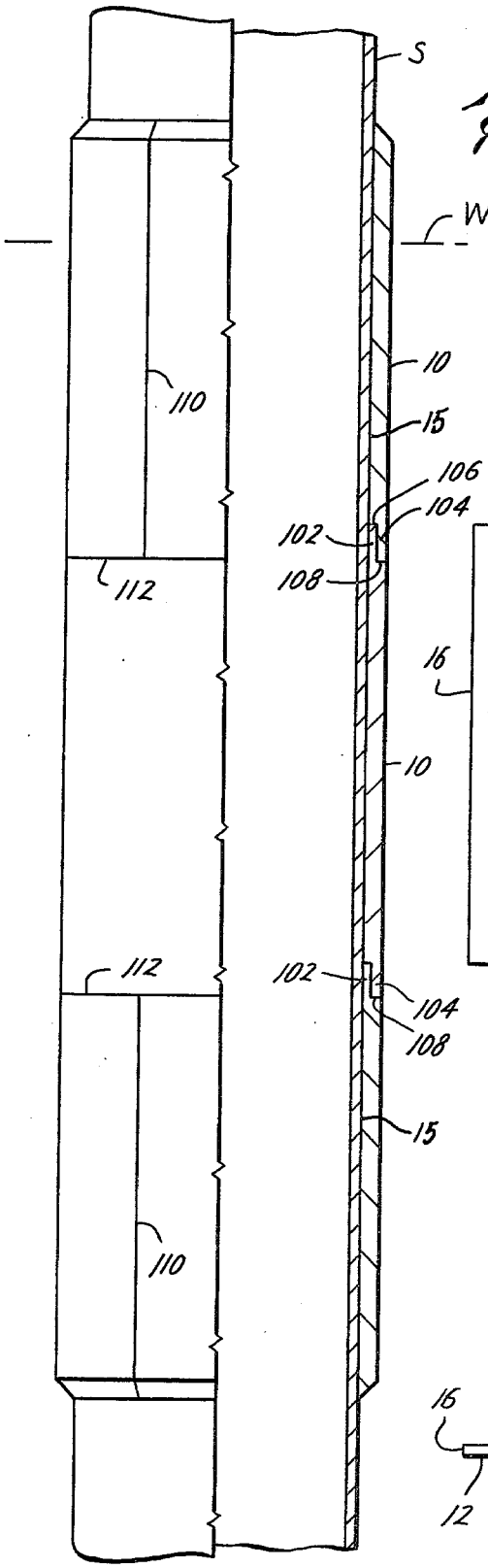
FIG. 6 is an elevational view, partly in section, of a second exemplary embodiment of the present invention mounted with offshore structure in the splash zone area.
Figure 7:
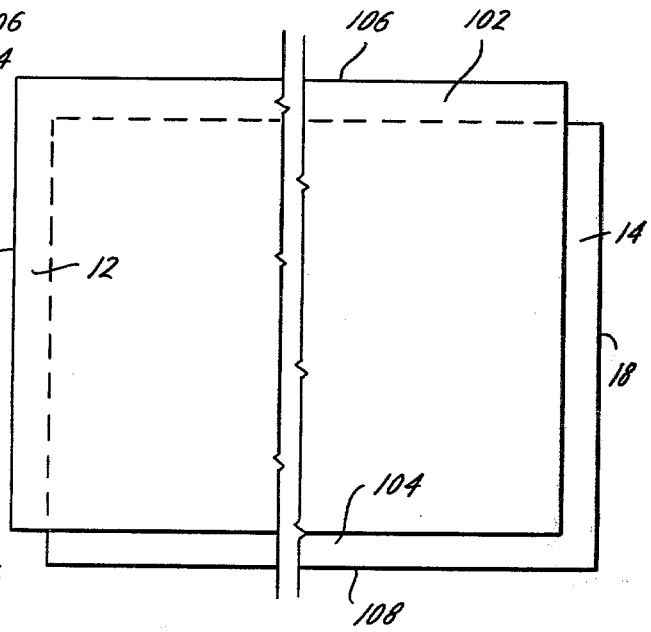
FIG. 7 is a view of an unwrapped piece of material illustrating certain aspects of the invention shown in FIG. 6.
Figure 8:
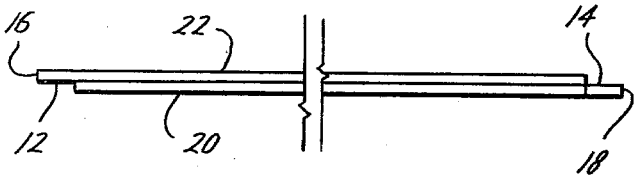
FIG. 8 is an end view of the unwrapped piece of material shown in FIG. 7.

As illustrated in FIGS. 3–5, body 10 is of a suitable width H and length L as desired for enabling wrapping around such offshore structures or risers. The structure S may be wrapped with a single body 10, as shown in FIGS. 3–5, or structure S may be wrapped with multiple bodies 10, as shown in FIGS. 6–8. The bodies of both embodiments have cut-away areas 12 and 14 extending along the edges 16 and 18 on opposite sides 20 and 22 of body 10. The depth of cut-away areas 12 and 14 are preferrably approximately one-half the thickness T of flexible member 10 in order to provide a single thickness of the wrap. For example, to cover a 30 inch pipe in a 30 foot wave zone area, the body 10 would have a width H of approximately 35 feet, a length L of approximately 106 inches, and cut-away areas 12 and 14 of approximately 6 inches each.

In applying the present invention to existing offshore structures S, the offshore structures are first cleaned by suitable means such as water blasting or sand blasting and a suitable epoxy or glue such as Durocal and/or cement rubber is positioned around such existing structures or flow line risers in the wave action area W or if desired, such epoxy or rubber can be positioned on side 22 of body 10. Body 10 is then wrapped around the legs or flow line risers in the wave action area W, as illustrated in FIG. 1, with the width H of the guard extending along the longitudinal length of structure S and the length L being at least the circumference of the structure S to be wrapped. Body 10 is wrapped around structure S such that 16 is first positioned and edge 18 is the last edge or end positioned and cut-away areas 12 and 14 overlap one another. In this manner, the total thickness T of body 10 is uniform around the wrapped structure S since areas 12 and 14 are of approximately one-half the thickness T of the non-cut-away area.

After guard 10 has been wrapped around structure S, suitable tape or other wrapping material 24 is wrapped around the exterior of body 10 beginning substantially toward the center of the wrapping material and extending outwardly toward the top 26 and bottom 28. Such outwardly extending wrapping and binding causes the epoxy material or glue to be evened out and further eliminates any cavities or pockets which might occur between body 10 and structure S. Such outwardly extending wrapping toward the upper and lower ends, 26 and 28, respectively, expels any water which might be positioned in the epoxy or between the guard and structure S to provide a suitable, safe and economical growth in the wave action area for offshore structures, legs, platforms and flow line risers.

It has also been found that wave zone areas W can be as great as 35 feet in certain areas of the world and thus a single wrap would be extremely heavy and difficult to mount on structure S. Accordingly, the guard may be constructed from a plurality of bodies 10, as shown in FIG. 6.

As best seen in FIGS. 7 and 8, each body 10 has cut-away areas 12 and 14 extending along edges 16 and 18 on opposite sides 20 and 22. Further, each body 10 has cut-away areas 102 and 104 extending along edges 106 and 108 on sides 20 and 22. Cut-away areas 12 and 104 are removed from the same side of body 10 while cut-away areas 14 and 104 are removed from the other side of the body. Preferably one-half the thickness T of each body 10 is removed to form cut-away areas 12, 14, 102 and 104, so as to provide a single thickness of body 10 when mounted to structure S by joining cut-away areas 102 and 104 on different bodies 10.

When mounting bodies 10 to structure S and thereby forming a guard, it will be noted that a vertical seam 110 is formed when cut-away area 12 is mounted to cut-away area 14 and a horizontal seam 112 is formed when cut-away area 104 of a first body 10 is mounted to cut-away area 102 of a second body 10. It is important to note that vertical seam 110 of the first body 10 must not be continuous with a second vertical seam 110 because two corners, which are diametrically opposed from one another, are completely removed when making cut-away areas 12, 14, 102 and 104. Thus, should vertical seams 118 be aligned, an access to structure S may develop.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

The invention having been described, what is claimed is:

1. A guard for protecting existing offshore structures, platforms, legs and the like from environmental conditions in the wave action area, including:

(a) an epoxy mounted around the periphery of the existing structure in the wave action area; and (b) a body of flexible material mounted with said epoxy on the structure suitable for protecting existing structures from environmental conditions.

(c) said body having (i) a width sufficient to extend throughout the wave action area, (ii) a length sufficient to enable said body to overlap when wrapped around the structure, and (iii) at least two cut-away areas on opposite sides of said body for overlapping one another.

(d) said cut-away areas of said body being of less thickness than the thickness of the non-overlap portion of said body while having complimentary thicknesses to enable said body to be of the same thickness when mounted with the existing structures.

2. The structure as set forth in claim 1, wherein the cut-away areas are approximately one-half the thickness the non-overlap area, one of said cut-away areas being positioned at one end of said material and extending along the width of said body and the other of said areas extending along the width at the opposite end of said body.

3. The structure as set forth in claim 1, wherein said body is constructed from a plurality of wraps, each wrap having two additional cut-away areas of approximately one-half the thickness of said flexible material, one of the additional cut-away areas being positioned at the end of said material along its length, and the other of said additional areas extending along the length at the opposite end of said body and on the opposite side, said guard being constructed by mounting a wrap around said structure and joining the two cut-away areas along its width and subsequently adding another wrap by mounting the cut-away areas along its width and the cut-away area along its length to the cut-away area along the length of the first wrap, the seam provided by joining the cut-away areas along the width of the first wrap being discontinuous with the seam formed by joining the cut-away areas along the width of the second wrap.

4. A method of protecting existing offshore tubular members in a wave action or splash zone area offshore, comprising the steps of:

a. selecting a suitable flexible material capable of preventing rust and damage to such tubular member in the wave action area;

b. forming a body from the selected material with a width sufficient to cover such tubular member along the wave action area and with a length sufficient to overlap when wrapped around the body;

c. removing at least two sections of said flexible material along the entire width of said body, said two sections being cut-away and thereafter being of approximately one-half the thickness of the non-cut-away portion of said body;

d. suitably cleaning and thereafter placing a suitable epoxy on such tubular members in the wave action area and on such surfaces of said body that come in contact with each other;

e. wrapping the flexible material around the tubular members in the wave action area such that the length of said body will cover the circumference of the tubular member and one cut-away portion will meet with the other cut-away portion of said body by a sufficient extent to permit overlap with a thickness of approximately the non-cut-away portion.

5. The method as set forth in claim 5, including the step of thereafter removing said wrapping material for forming a suitable guard around such tubular member in the wave action area.

6. The method as set forth in claim 4, including the steps of providing a plurality of wraps, each wrap having cut out areas along its length for overlapping a corresponding cut out portion on a previous wrap; said guard being mounted to said structure by providing a first wrap to said structure and then mounting a second wrap to said structure, the wraps being mounted so that the vertical seams formed by mounting the wraps to said structure are discontinuous along the wave action area.

* * * * *